US010653281B2

(12) United States Patent
Gierer et al.

(10) Patent No.: US 10,653,281 B2
(45) Date of Patent: May 19, 2020

(54) PRE-FILTER BAG FOR VACUUM CLEANER AND VACUUM CLEANER INCLUDING SAME

(71) Applicant: Emerson Electric Co., St. Louis, MO (US)

(72) Inventors: Joseph T. Gierer, Glen Carbon, IL (US); Daniel M. Henke, Edwardsville, IL (US); Jason E. Hill, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 187 days.

(21) Appl. No.: 15/686,749

(22) Filed: Aug. 25, 2017

(65) Prior Publication Data

US 2019/0059666 A1 Feb. 28, 2019

(51) Int. Cl.

| | |
|---|---|
| ***A47L 9/14*** | (2006.01) |
| ***A47L 5/36*** | (2006.01) |
| ***A47L 7/00*** | (2006.01) |
| ***A47L 9/22*** | (2006.01) |
| ***A47L 9/12*** | (2006.01) |

(52) U.S. Cl.

CPC ..... *A47L 5/362* (2013.01); *A47L 5/365* (2013.01); *A47L 7/0004* (2013.01); *A47L 7/0023* (2013.01); *A47L 9/127* (2013.01); *A47L 9/14* (2013.01); *A47L 9/22* (2013.01)

(58) Field of Classification Search

CPC ..... A47L 5/362; A47L 5/365; A47L 7/0004; A47L 7/0023; A47L 9/127; A47L 9/14; A47L 9/22; A47L 5/28; A47L 9/1683; A47L 9/1666; A47L 9/1691

See application file for complete search history.

(56) References Cited

U.S. PATENT DOCUMENTS

| | | | | |
|---|---|---|---|---|
| 2,696,894 A | | 12/1954 | Forsberg | |
| 2,734,594 A | * | 2/1956 | Meeker | A47L 5/365 55/363 |
| 2,771,152 A | | 11/1956 | Bramhall et al. | |
| 2,870,863 A | | 1/1959 | Bramhall | |
| 2,905,267 A | | 9/1959 | Thompson | |
| 3,297,231 A | | 1/1967 | Fesco | |
| 3,350,857 A | * | 11/1967 | Fesco | A47L 9/14 55/363 |

(Continued)

FOREIGN PATENT DOCUMENTS

EP 2886182 A1 6/2015

*Primary Examiner* — Robert J Scruggs

(74) *Attorney, Agent, or Firm* — Armstrong Teasdale LLP

(57) ABSTRACT

A vacuum cleaner includes a canister, a power head connected to a top of the canister, an inlet defined by one of the canister and the power head, an outlet defined by one of the canister and the power head, and a pre-filter bag disposed within the canister and fluidly connected between the inlet and the outlet. The power head includes an impeller assembly operable to generate airflow through the canister from the inlet to the outlet. The pre-filter bag includes an inlet port connected to the inlet, a radial inner wall, and a radial outer wall. The radial inner wall and the radial outer wall at least partially define an internal cavity and extend circumferentially about a central axis of the pre-filter bag such that the internal cavity forms a continuous, closed loop.

25 Claims, 9 Drawing Sheets

(56) References Cited

U.S. PATENT DOCUMENTS

| | | | | | |
|---|---|---|---|---|---|
| 3,479,802 | A | * | 11/1969 | Fesco | A47L 9/14 156/263 |
| 3,480,987 | A | | 12/1969 | Schaefer | |
| 3,973,936 | A | | 8/1976 | Howard et al. | |
| 4,127,396 | A | | 11/1978 | Tortorici et al. | |
| 4,229,193 | A | * | 10/1980 | Miller | A47L 9/14 55/318 |
| 5,259,087 | A | * | 11/1993 | Loveless | A47L 7/0071 15/327.2 |
| 5,690,710 | A | | 11/1997 | Stephan | |
| 8,110,025 | B1 | | 2/2012 | Schwaiger | |
| 9,005,325 | B2 | | 4/2015 | Smith | |
| 9,107,550 | B2 | | 8/2015 | Sergyeyenko et al. | |
| 2007/0174993 | A1 | | 8/2007 | Dever et al. | |
| 2011/0131756 | A1 | | 6/2011 | Curien | |
| 2011/0308208 | A1 | | 12/2011 | Herndon et al. | |
| 2016/0206169 | A1 | | 7/2016 | Hyun et al. | |

* cited by examiner

PRE-FILTER BAG FOR VACUUM CLEANER AND VACUUM CLEANER INCLUDING SAME

FIELD

The field of the disclosure relates generally to vacuum cleaners and, more particularly, pre-filter bags for vacuum cleaners.

BACKGROUND

Vacuum appliances often include lid-mounted motors that facilitate the movement of air through a drum to which the lid is attached. Vacuum appliances, in particular vacuum cleaners and wet/dry vacuum cleaners, generally include means for separating the dust and the dirt from the air that is exhausted back into the surrounding environment during operation. Accordingly, vacuum cleaners and wet/dry vacuum cleaners often use vacuum bags that allow particulates to be captured in the bag. Previous vacuum bag designs have closed-ended constructions that do not accommodate a continuous, circumferential flow of air through the bag.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

In one aspect, a vacuum cleaner includes a canister, a power head connected to a top of the canister, an inlet defined by one of the canister and the power head, an outlet defined by one of the canister and the power head, and a pre-filter bag disposed within the canister and fluidly connected between the inlet and the outlet. The power includes an impeller assembly that is operable to generate airflow through the canister from the inlet to the outlet. The pre-filter bag includes an inlet port connected to the inlet, a radial inner wall, and a radial outer wall. The radial inner wall and the radial outer wall at least partially define an internal cavity, and extend circumferentially about a central axis of the pre-filter bag such that the internal cavity forms a continuous, closed loop.

In another aspect, a pre-filter bag for a vacuum cleaner includes an inlet port that connects to an inlet of the vacuum cleaner, a radial inner wall, and a radial outer wall. The radial inner wall and the radial outer wall at least partially define an internal cavity, and extend circumferentially about a central axis of the pre-filter bag such that the internal cavity forms a continuous, closed loop.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

Embodiments of the present disclosure relate to pre-filter bags for use with vacuum cleaners, such as wet/dry vacuum cleaners, in which inlet airflow is directed tangentially relative to the central axis of a vacuum cleaner to create circumferential air flow inside the cylindrical canister. Embodiments of the pre-filter bags are designed to allow for continuous airflow via a cyclonic airflow, and act as pre-filter separators that allow captured debris to fall to the bottom of the bag without face-loading a vacuum filter component (i.e., occluding or blocking airflow through a face of the filter component).

Figure 1:
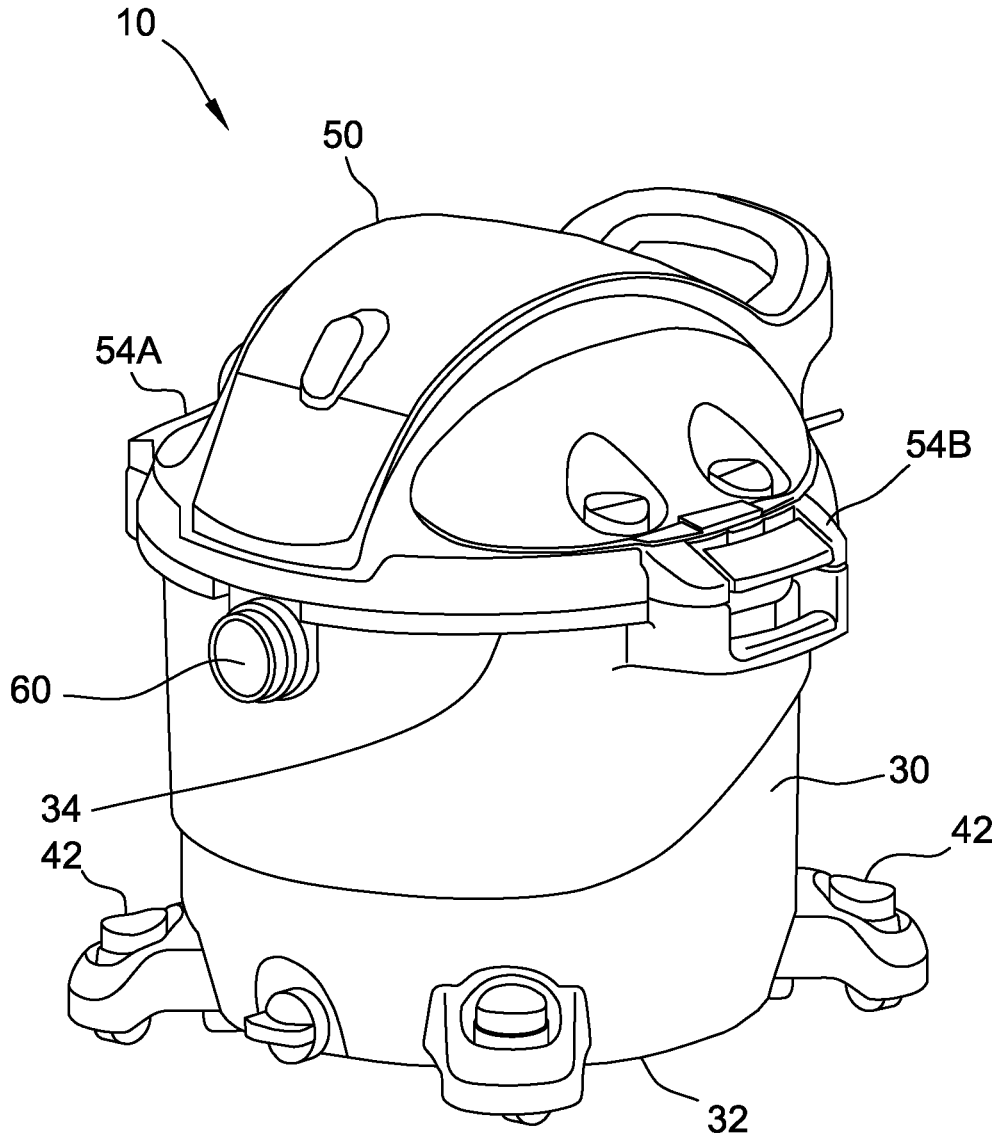
FIG. 1 is a perspective view of an example vacuum cleaner.

FIG. 1 is a perspective view of an example vacuum cleaner 10 for use with the vacuum pre-filter bags of the present disclosure. In the illustrated embodiment, vacuum cleaner 10 is a wet/dry vacuum cleaner including a collection drum or canister 30 defining an inlet 60, casters 42 mounted on a bottom end 32 of the canister 30, and a power head 50 removably attached to a top end 34 of the canister 30. The power head 50 is removably attached (e.g., via a hinge mechanism or latches 54*a* and 54*b*) to the canister 30 so that the power head 50 can be readily removed so as to empty debris or liquids contained within the canister 30. The power head 50 includes a motor 104 and a fan or impeller 106 (collectively referred to as an impeller assembly 113, shown in FIG. 2), which is operable to generate airflow through the canister 30 from the inlet 60 to an outlet 112 (shown in FIG. 2) so as to draw solid debris, liquid, or both into the canister 30 through the inlet 60 by way of a vacuum hose (not shown). In the example embodiment, the inlet 60 is defined by the canister 30, and the outlet 112 is defined by the power head 50. In other embodiments, the inlet 60 and the outlet 112 may be defined by any suitable portion of the vacuum cleaner 10 that enables the vacuum cleaner 10 to function as described herein. In some embodiments, for example, the inlet 60 may be defined by the power head 50.

Figure 2:
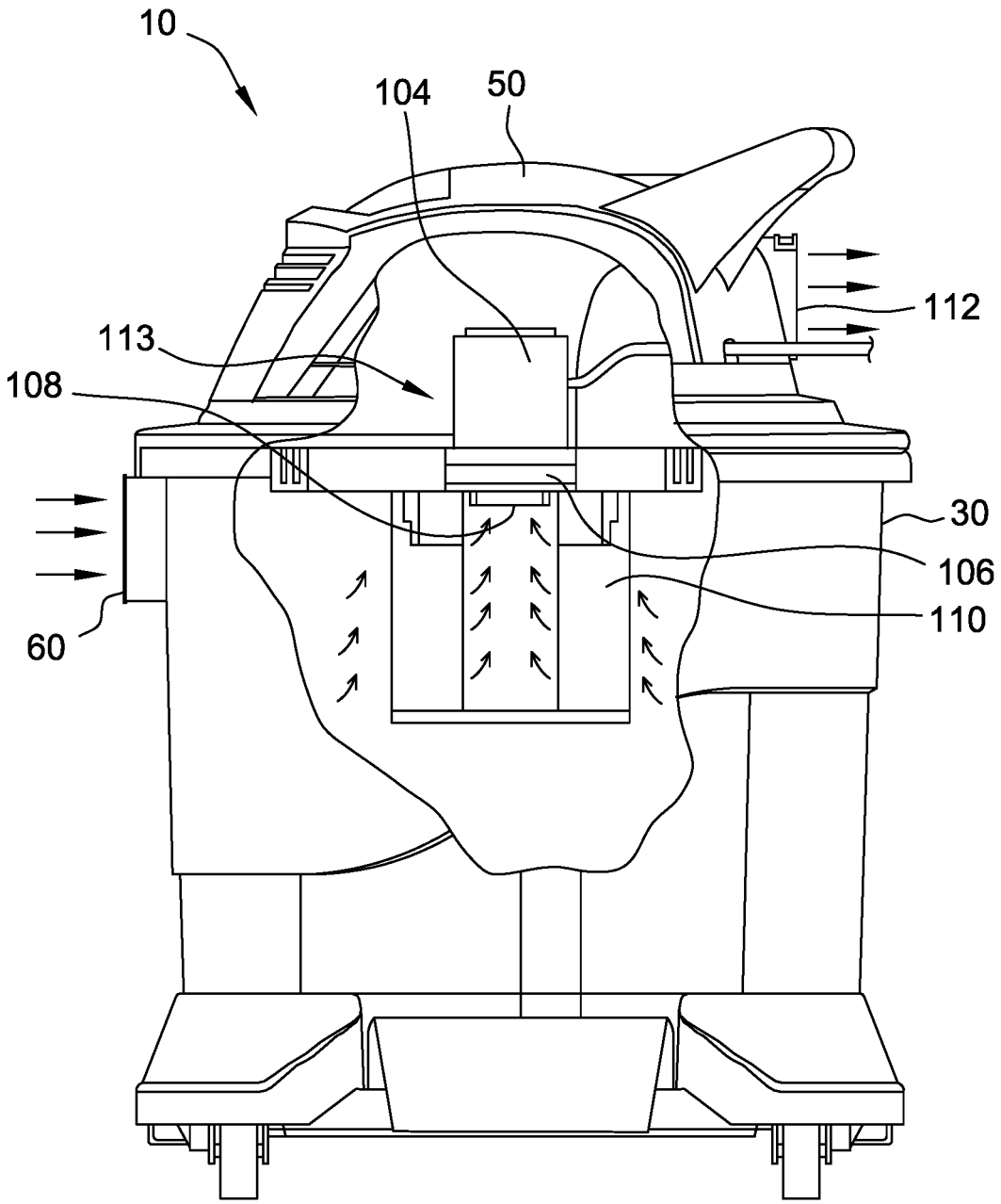
FIG. 2 is a side view of the vacuum cleaner of FIG. 1, with a partial cut-away showing the interior of the vacuum cleaner.

FIG. 2 is a partial cut-away view of the vacuum cleaner 10 of FIG. 1. As noted above, the vacuum cleaner 10 includes the impeller assembly 113, which is connected to a top of the canister 30. As shown in FIG. 2, the impeller assembly 113 is housed within the power head 50, and is operable to generate air flow through the canister 30 from the inlet 60 to the outlet 112.

In the illustrated embodiment, the vacuum cleaner 10 further includes a filter assembly 110 connected to, and depending downward from, the power head 50. In operation, when the motor 104 is energized, in vacuum mode, for example, air flows into the canister 30 through the vacuum inlet 60, through the filter assembly 110, and into the power head 50 through an air inlet 108, before being exhausted back into an environment surrounding the vacuum cleaner 10 through the outlet 112. This vacuum air flow pattern is illustrated generally by the arrows in FIG. 2.

Figure 3:
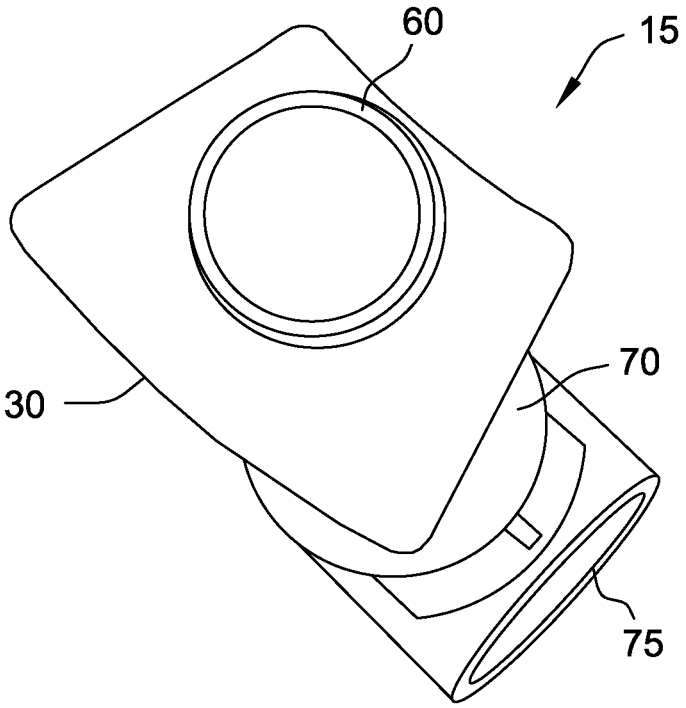
FIG. 3 is a perspective view of a flow-guide section of the vacuum cleaner of FIG. 1.

In some embodiments, the vacuum cleaner 10 may also include a flow guide for directing air flow through the canister 30 in a predetermine path. FIG. 3 is a perspective view of an example flow-guide section 15 suitable for use with the vacuum cleaner of FIG. 1. In the illustrated embodiment, the flow-guide section 15 is shown as being connected to the inlet 60 of the vacuum cleaner 10 of FIG. 1. The flow-guide section 15 is operable to direct air received into the inlet 60 through the canister 30 in a cyclonic flow or path. In the illustrated embodiment, the flow-guide section 15 is connected to the inlet 60, and includes a hollow, cylindrical tube or conduit 70 extending radially inward from the inlet 60. The conduit 70 also defines a flow-guide outlet 75 in fluid communication with the inlet 60. The conduit 70 includes an approximate 90° bend or angle such that the outlet 75 is oriented substantially orthogonal to the inlet 60. Consequently, the flow-guide section 15 directs air drawn through the inlet 60 into a cyclonic flow pattern within canister 30.

Figure 4:
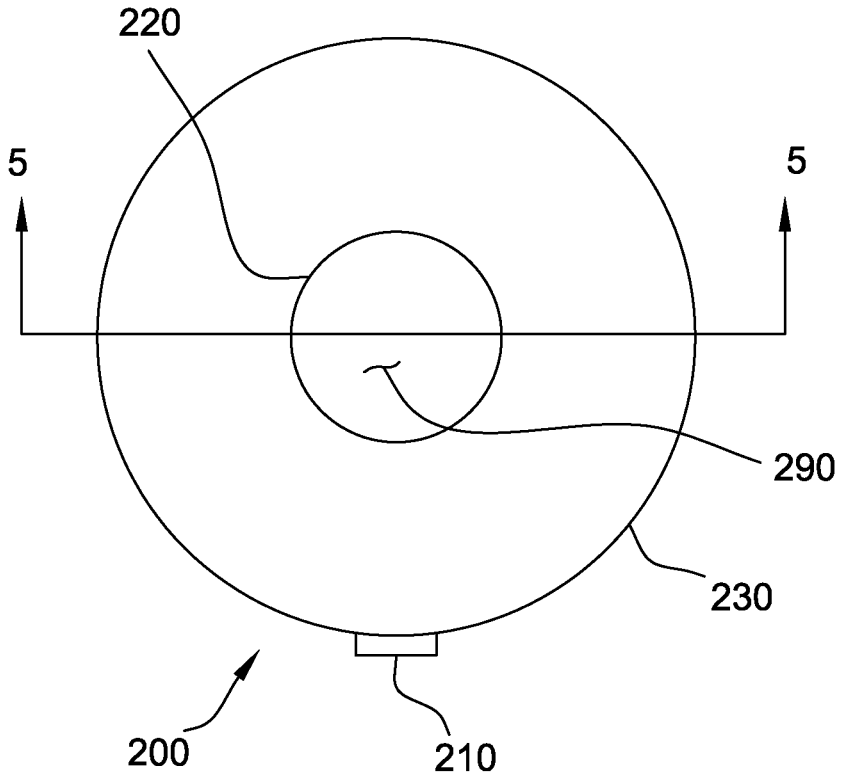
FIG. 4 is a schematic top view of an example pre-filter bag suitable for use with the vacuum cleaner of FIG. 1.
Figure 5:
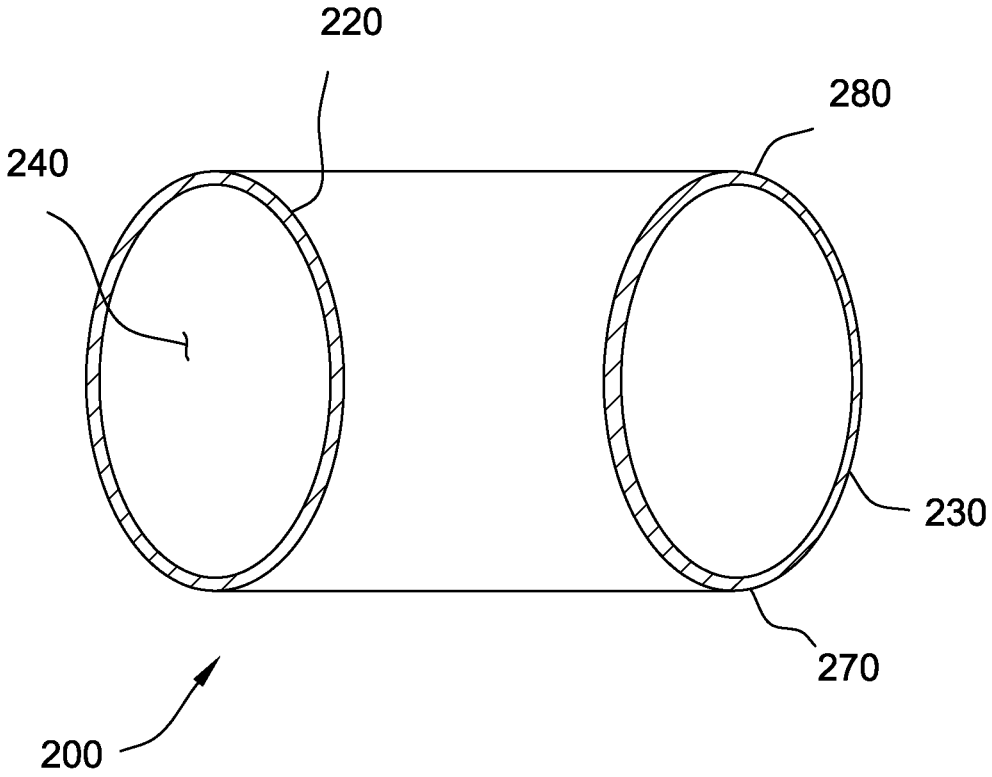
FIG. 5 is a sectional view of the pre-filter bag shown in FIG. 4 taken along line "5-5".

FIG. 4 is a schematic top view of an example pre-filter bag 200 suitable for use with the vacuum cleaner 10 of FIG. 1, and FIG. 5 is a sectional view of the pre-filter bag 200 taken along line "5-5" in FIG. 4. The pre-filter bag 200 includes an inlet port 210 that connects to the canister inlet 60 when the pre-filter bag 200 is installed in the vacuum cleaner 10. The pre-filter bag 200 also includes a radial inner wall 220 and a radial outer wall 230. The radial inner wall 220 and the radial outer wall 230 at least partially define an internal cavity 240 (FIG. 5) in which debris, dust, and other particles entrained within the vacuum air flow are collected during operation of the vacuum cleaner 10. The radial inner walls and outer walls 220 and 230 extend circumferentially about a central axis of the pre-filter bag 200 such that the internal cavity forms a continuous, closed loop. The pre-filter bag 200 defines a central cavity 290 separated from the internal cavity 240 by the radial inner wall 220. As shown in FIG. 4, the pre-filter bag 200 extends entirely around the central cavity 290. The central cavity 290 is sized and shaped to receive a vacuum filter therein, such as the vacuum filter 110 of the vacuum cleaner 10. In the example embodiment, the pre-filter bag 200 is toroid-shaped. In other embodiments, the pre-filter bag 200 may be any other shape that allows the pre-filter bag 200 to function as described herein.

The pre-filter bag 200 also includes a bottom wall 270 extending radially inward from the radial outer wall 230 to at least the radial inner wall 220, and a top wall 280 extending radially inward from the radial outer wall 230 to the radial inner wall 220. In the embodiment of FIG. 4, the bottom wall 270 extends from the radial outer wall 230 to the radial inner wall 220. In the example embodiment, the radial inner wall 220, radial outer wall 230, top wall 280, and bottom wall 270 cooperatively define the internal cavity 240.

The pre-filter bag 200 is constructed of a filtering media that traps dirt, dust, and particles in the air stream entering through the vacuum cleaner inlet 60, while allowing at least partially filtered air to pass through under the influence of a vacuum created by the impeller assembly 113. For example, the pre-filter bag 200 may be constructed of a cloth or woven material, such as a woven nylon, paper, or any other suitable material that enables the pre-filter bag 200 to function as described herein. The pre-filter bag 200 may be constructed of a single piece or sheet of filtering media, or may be constructed of two or more pieces or sheets of filtering media. In some embodiments, for example, the radial inner wall 220, radial outer wall 230, bottom wall 270, and top wall 280 are constructed of a single, continuous piece or sheet of filtering media.

Figure 6:
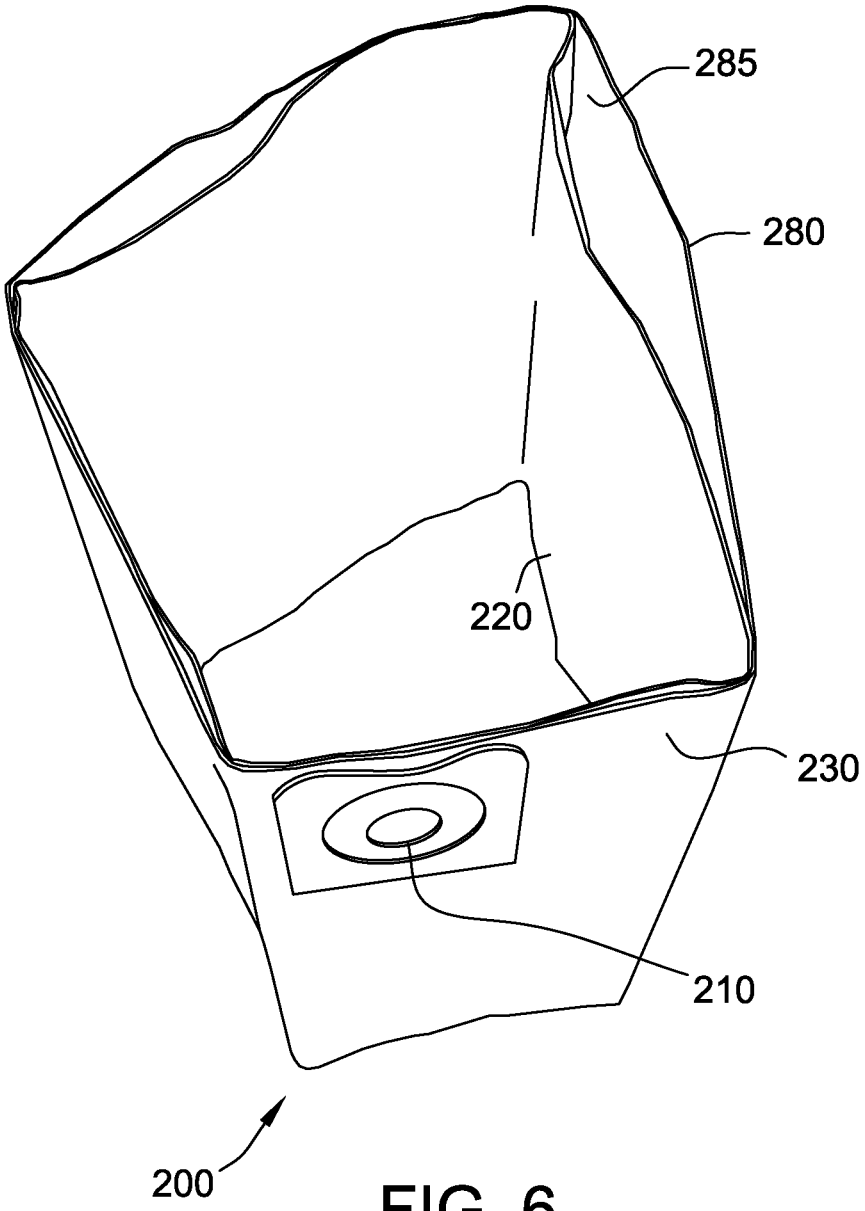
FIG. 6 is a perspective view of the pre-filter bag shown in FIGS. 4 and 5.

FIG. 6 is a perspective view of the pre-filter bag 200 shown in FIGS. 4 and 5. As shown in FIG. 6, the pre-filter bag 200 may include one or more pleats 285 to accommodate radial and/or axial expansion of the pre-filter bag 200. In the illustrated embodiment, for example, the top wall 280 includes a pleat 285 that permits radial expansion of the pre-filter bag 200 during operation of a vacuum cleaner. In some embodiments, pleats 285 are disposed circumferentially along the outer wall 230 and centered about the main central axis to allow for expansion of the pre-filter bag 200 in an axial direction. Further, in some embodiments, pleats 285 are employed, either separately or in any combination, along the radial inner wall 220, the top wall 280, the radial outer wall 230, and the bottom wall 270 of the pre-filter bag 200 to accommodate radial and/or axial expansion of the pre-filter bag 200.

Figure 7:
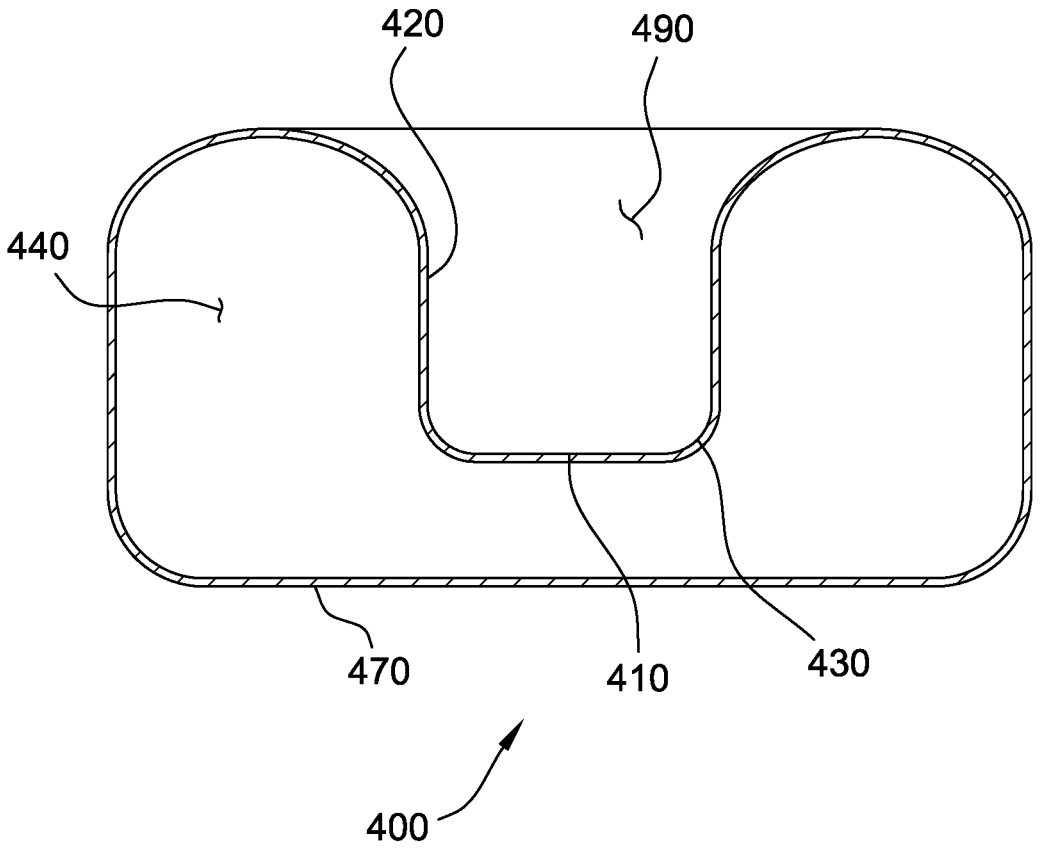
FIG. 7 is a sectional view of another example pre-filter bag suitable for use with the vacuum cleaner of FIG. 1.

FIG. 7 is a schematic sectional view of another embodiment of a pre-filter bag 400 suitable for use with the vacuum cleaner 10 of FIG. 1. The pre-filter bag 400 is substantially similar to the pre-filter bag 200 shown in FIGS. 4-6, except the pre-filter bag 400 includes an internal wall 410 that extends radially inward from a lower edge 430 of a radial inner wall 420 to a center of the bag. As shown in FIG. 7, the internal wall 410 is spaced from a bottom wall 470 of the pre-filter bag 400 by an internal cavity 440 of the pre-filter bag 400. In this embodiment, a central cavity 490 is defined by the radial inner wall 420 and the internal wall 410. In this embodiment, the internal wall 410 encloses additional space within the internal cavity 440 to provide additional capacity for storing debris, dust, and other particles.

Figure 8:
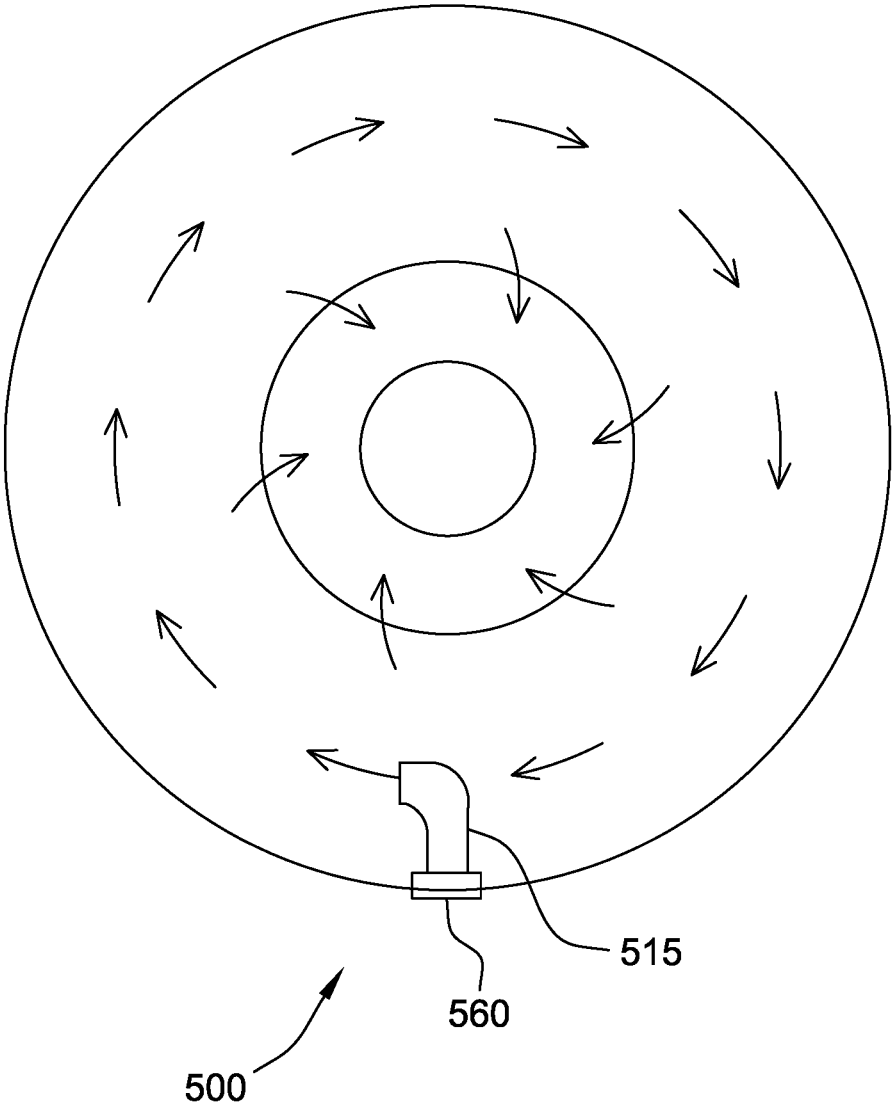
FIG. 8 is a schematic top view of an example pre-filter bag including a flow-guide section that is suitable for use with the vacuum cleaner of FIG. 1.

FIG. 8 is a top schematic view of another embodiment of a pre-filter bag 500 suitable for use with the vacuum cleaner 10 of FIG. 1. The pre-filter bag 500 is substantially similar to the pre-filter bag 200, except the pre-filter bag 500 includes a flow guide 515 connected to an inlet port 560 of the pre-filter bag 500. Similar to the flow-guide section 15 shown in FIG. 3, the flow guide 515 is operable to re-direct air entering the pre-filter bag 500 to create a cyclonic air flow within the pre-filter bag 500. In some embodiments, the flow guide 515 may be formed integrally (i.e., as an integral part of) the pre-filter bag 500. Embodiments that include a flow guide facilitate generating a cyclonic air flow in vacuum cleaners that do not have a flow-guide section, such as the flow-guide section 15.

Figure 9:
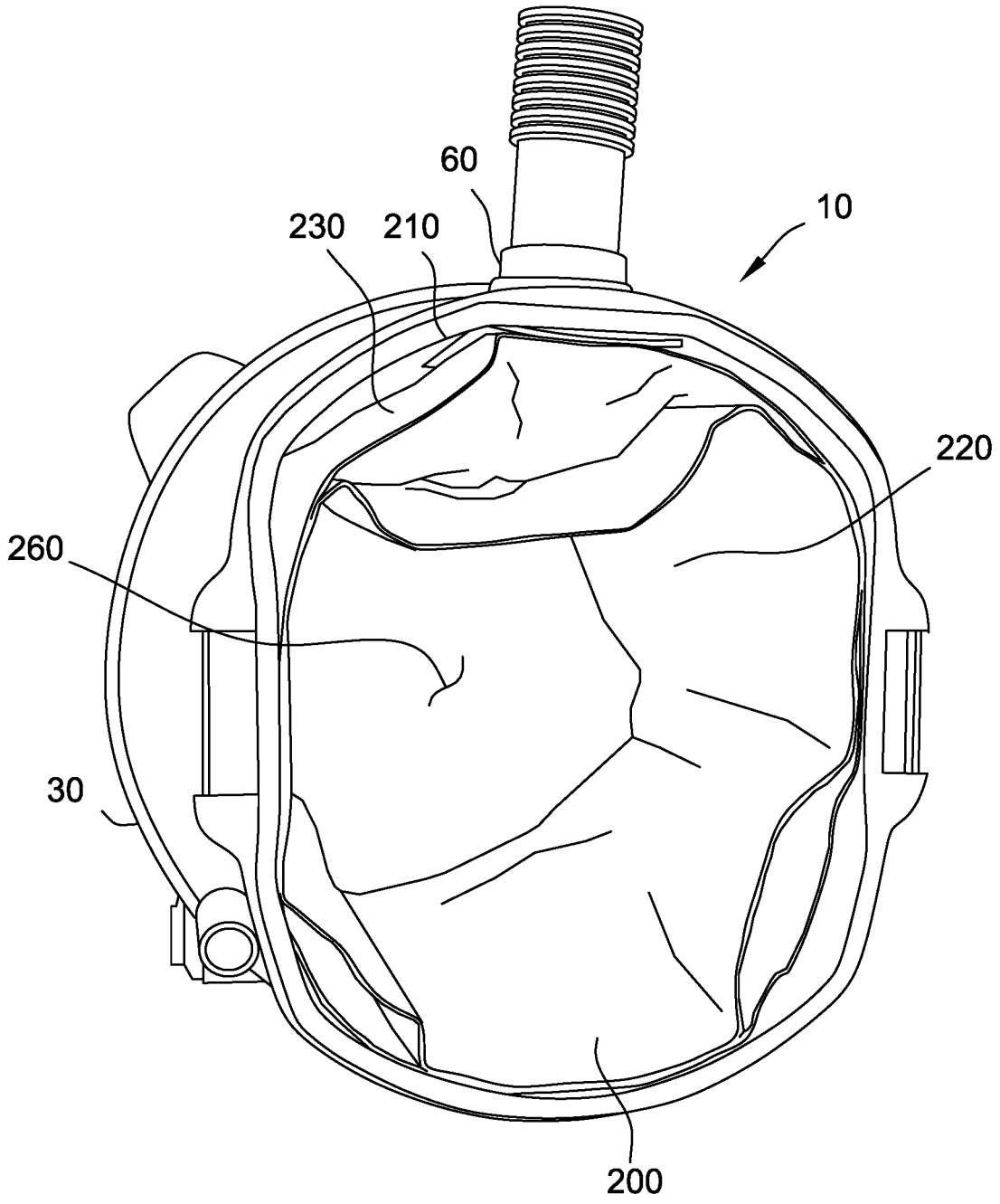
FIG. 9 is a perspective view of the pre-filter bag of FIGS. 4-6 disposed within the canister of the vacuum cleaner shown in FIG. 1.

FIG. 9 is a top view of the pre-filter bag 200 of FIGS. 4-6 disposed within the canister 30 of the vacuum cleaner 10. When the vacuum cleaner 10 is fully assembled with the pre-filter bag 200, the pre-filter bag 200 is fluidly connected between the canister inlet 60 and the outlet 112, and the filter assembly 110 (FIG. 2) is received within the central cavity 260. The pre-filter bag 200 is removable from the canister 30 such that dust and other debris collected within the pre-filter bag 200 may be discarded, along with the pre-filter bag 200, without generating airborne particles.

In operation, the motor 104 of the vacuum cleaner 10 is activated, causing the impeller 106 to rotate and produce a negative pressure gradient between the inlet 60 and the outlet 112. This pressure gradient causes unfiltered air to flow into the canister 30 through the inlet 60 into the pre-filter bag 200. The flow-guide section 15 directs the unfiltered air in a cyclonic flow around the circumference of the pre-filter bag 200. This causes the pre-filter bag 200 to expand as the unfiltered air fills the pre-filter bag 200 and circulates within the internal cavity 240 of the pre-filter bag 200. Dust and other debris in the circulating air fall to the bottom of the pre-filter bag 200, where the dust and other debris are trapped within the pre-filter bag 200 by the filtering media. Pre-filtered air passes through the filtering media of the pre-filter bag 200 and enters the central cavity 290 within the canister 30 of the vacuum cleaner 10. The pre-filtered air passes through filter assembly 110 and into the power head 50 through the air inlet 108. Filtered air leaves the power head 50 through the outlet 112 and is discharged to the surrounding environment.

Embodiments of the pre-filter bags and vacuum cleaning systems described herein achieve superior results as compared to previous vacuum cleaners and filters. For example, embodiments of the pre-filter bags of the present disclosure define an internal cavity that forms a continuous, closed loop, thereby enabling continuous, cyclonic airflow within the canister of a vacuum cleaner. The cyclonic air flow allows debris to collect at the bottom of the bag, and facilitates reduced face loading of the pre-filter bag and the downstream filter assemblies of the vacuum cleaner. Embodiments of the pre-filter bags are also removable from vacuum cleaners, thereby providing for easy removal and discarding of the collected dust and debris from the vacuum cleaner canister. The easy removal and discarding of the collected dust and debris facilitates preventing potentially harmful particulates from escaping into an airspace, and thereby facilitates reducing airborne particles.

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing (s) shall be interpreted as illustrative and not in a limiting sense.

What is claimed is:

1. A vacuum cleaner comprising:

a canister;

a power head connected to a top of the canister and including an impeller assembly;

an inlet defined by one of the canister and the power head;

an outlet defined by one of the canister and the power head, wherein the impeller assembly is operable to generate airflow through the canister from the inlet to the outlet; and a pre-filter bag disposed within the canister and fluidly connected between the inlet and the outlet, the pre-filter bag including:

an inlet port connected to the inlet;

a radial inner wall; and a radial outer wall, wherein the radial inner wall and the radial outer wall at least partially define an internal cavity and extend around a central axis of the pre-filter bag such that the internal cavity forms a continuous, closed loop that promotes cyclonic airflow throughout the continuous, closed loop, wherein the pre-filter bag is toroid-shaped and defines a central cavity separated from the internal cavity by the radial inner wall, the central cavity sized and shaped to receive a cylindrical vacuum filter therein.

2. The vacuum cleaner of claim 1, further comprising a filter connected to and depending from the power head, wherein the filter is received within the central cavity.

3. The vacuum cleaner of claim 1, wherein the pre-filter bag is removable from the canister.

4. The vacuum cleaner of claim 1, wherein the inlet includes a flow-guide section operable to direct air flowing through the canister in a cyclonic flow.

5. The vacuum cleaner of claim 1, wherein the pre-filter bag further includes a flow guide connected to the inlet port and operable to re-direct air entering the pre-filter bag to create a cyclonic air flow within the pre-filter bag.

6. The vacuum cleaner of claim 1, wherein the pre-filter bag further includes a bottom wall extending radially inward from the radial outer wall to the radial inner wall.

7. The vacuum cleaner of claim 6, wherein the bottom wall is pleated to accommodate radial expansion of the pre-filter bag.

8. The vacuum cleaner of claim 1, wherein the pre-filter bag is constructed of flexible filter media.

9. A pre-filter bag for a vacuum cleaner, the pre-filter bag comprising:

an inlet port that connects to an inlet of the vacuum cleaner;

a radial inner wall; and a radial outer wall, wherein the radial inner wall and the radial outer wall at least partially define an internal cavity and extend around a central axis of the pre-filter bag such that the internal cavity forms a continuous, closed loop that promotes cyclonic airflow throughout the continuous, closed loop, wherein the pre-filter bag defines a central cavity separated from the internal cavity by the radial inner wall, the central cavity sized and shaped to receive a cylindrical vacuum filter therein.

10. The pre-filter bag of claim 9, wherein the inlet port is located on the radial outer wall.

11. The pre-filter bag of claim 9, wherein the pre-filter bag further includes a flow guide connected to the inlet port and operable to re-direct air entering the pre-filter bag to create a cyclonic air flow within the pre-filter bag.

12. The pre-filter bag of claim 9, wherein the pre-filter bag further includes a bottom wall extending radially inward from the radial outer wall to at least the radial inner wall.

13. The pre-filter bag of claim 12, wherein the pre-filter bag further includes an internal wall extending radially inward from a lower edge of the radial inner wall, wherein the internal wall is spaced from the bottom wall by the internal cavity of the pre-filter bag.

14. The pre-filter bag of claim 12, wherein the bottom wall extends from the radial outer wall to the radial inner wall.

15. The pre-filter bag of claim 12, wherein the bottom wall is pleated to accommodate radial expansion of the pre-filter bag.

16. The pre-filter bag of claim 9, wherein the pre-filter bag is constructed of flexible filter media.

17. The pre-filter bag of claim 9, wherein the pre-filter bag is toroid-shaped.

18. The pre-filter bag of claim 9 including:

a top wall extending radially inward from the radial outer wall to the radial inner wall; and a bottom wall extending radially inward from the radial outer wall to at least the radial inner wall, wherein at least one of the radial inner wall, the radial outer wall, the top wall, and the bottom wall is pleated to accommodate at least one of radial and axial expansion of the pre-filter bag.

19. A filter bag for a vacuum cleaner, the filter bag comprising:

an inlet port that connects to an inlet of the vacuum cleaner;

a radial inner wall; and a radial outer wall, wherein the radial inner wall and the radial outer wall at least partially define an internal airflow cavity and extend around a central axis of the filter bag such that the internal airflow cavity extends circumferentially completely around the central axis and forms a continuous, closed loop that promotes cyclonic airflow throughout the continuous, closed loop, wherein the filter bag defines a central cavity separated from the internal cavity by the radial inner wall.

20. The filter bag of claim 19, wherein the inlet port is located on the radial outer wall.

21. The filter bag of claim 19 further including a flow guide connected to the inlet port and operable to re-direct air entering the filter bag to create a cyclonic air flow within the filter bag.

22. The filter bag of claim 19, wherein the filter bag further includes a bottom wall extending radially inward from the radial outer wall to at least the radial inner wall.

23. The filter bag of claim 22, wherein the filter bag further includes an internal wall extending radially inward from a lower edge of the radial inner wall, wherein the internal wall is spaced from the bottom wall by the internal cavity of the filter bag.

24. The filter bag of claim 22, wherein the bottom wall is pleated to accommodate radial expansion of the filter bag.

25. The filter bag of claim 19, wherein the filter bag is toroid-shaped.

* * * * *